US011738246B2

(12) United States Patent
Inoue

(10) Patent No.: US 11,738,246 B2
(45) Date of Patent: Aug. 29, 2023

(54) GOLF SHAFT AND METHOD OF MANUFACTURING THE SAME

(71) Applicant: NHK SPRING CO., LTD., Yokohama (JP)

(72) Inventor: Akihisa Inoue, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 0 days.

(21) Appl. No.: 17/776,634

(22) PCT Filed: Oct. 27, 2021

(86) PCT No.: PCT/JP2021/039587

§ 371 (c)(1),
(2) Date: May 13, 2022

(87) PCT Pub. No.: WO2022/102401

PCT Pub. Date: May 19, 2022

(65) Prior Publication Data

US 2022/0347531 A1 Nov. 3, 2022

(30) Foreign Application Priority Data

Nov. 11, 2020 (JP) ..... 2020-188309

(51) Int. Cl.
*A63B 53/12* (2015.01)
*C25D 3/04* (2006.01)
(Continued)

(52) U.S. Cl.
CPC ..... *A63B 53/12* (2013.01); *C25D 3/04* (2013.01); *C25D 3/12* (2013.01); *C25D 5/14* (2013.01);
(Continued)

(58) Field of Classification Search
CPC ..... A63B 53/12; C25D 3/04–10; C25D 5/627
See application file for complete search history.

(56) References Cited

U.S. PATENT DOCUMENTS 3,288,574 A * 11/1966 Du Rose ..... C25D 5/14 428/656
3,442,777 A * 5/1969 Woods ..... C25D 3/04 205/285
(Continued)

FOREIGN PATENT DOCUMENTS

JP 10-234899 A 9/1998
JP 2009-285043 A 12/2009
(Continued)

OTHER PUBLICATIONS

Chinese Office Action dated Oct. 31, 2022 for the Chinese counterpart application No. 202180006702.9.

*Primary Examiner* — Adam Krupicka
(74) *Attorney, Agent, or Firm* — Norris McLaughlin, P.A.

(57) ABSTRACT

Provided is a golf shaft, capable of ensuring peeling resistance of a colored layer to endure a bending process and the like. The golf shaft has a metal element tube, and a colored plating layer being a colored layer formed on a surface of the element tube, wherein the colored plating layer has a first strike plating layer on the element tube side, a satin-like plating layer layered on a surface of the first strike plating layer, a second strike plating layer layered on a surface of the satin-like plating layer, and a decorative plating layer layered on a surface of the second strike plating layer and colored according to a color of the colored plating layer.

8 Claims, 4 Drawing Sheets

(51) Int. Cl.

| | |
|---|---|
| ***C25D 5/14*** | (2006.01) |
| ***C25D 5/00*** | (2006.01) |
| ***C25D 3/12*** | (2006.01) |
| ***C25D 7/04*** | (2006.01) |

(52) U.S. Cl.
CPC ..... *C25D 5/627* (2020.08); *C25D 7/04* (2013.01); *Y10T 428/12854* (2015.01)

(56) References Cited

U.S. PATENT DOCUMENTS

| | | | |
|---|---|---|---|
| 5,655,981 | A | 8/1997 | Reed |
| 2009/0298608 | A1 | 12/2009 | Yatsuda |
| 2014/0073449 | A1 | 3/2014 | Folck et al. |
| 2016/0059095 | A1 | 3/2016 | Hodgson |
| 2020/0108300 | A1 | 4/2020 | Fujiwara et al. |

FOREIGN PATENT DOCUMENTS

| | | | |
|---|---|---|---|
| JP | 3157018 | U | 1/2010 |
| JP | 2013-142188 | A | 7/2013 |
| JP | 2019-5160 | A | 1/2019 |
| JP | 2020-99543 | A | 7/2020 |

* cited by examiner

GOLF SHAFT AND METHOD OF MANUFACTURING THE SAME

FIELD OF THE INVENTION

The present invention relates to a golf shaft in which an element tube made of metal is covered with a colored plating layer and a method of manufacturing the same.

BACKGROUND OF THE INVENTION

A golf shaft made of a metal element tube (hereinafter referred to as "metal shaft" in some cases) generally has a metallic color in appearance, it is a simple design and another color may be desired instead of the metallic color. As a coloring technique for such a metal shaft, there is disclosed in Patent document 1, for example.

The technique of Patent document 1 forms a nickel coating layer on a surface of a metal element tube, a chromium plating coating layer on a surface of the nickel coating layer, and a color anion electrodeposition paint film layer as a colored layer on a surface of the chromium plating coating layer.

The technique enhances designability of the metal shaft with color. The colored layer according to the paint film, however, has low adhesion and is peeled off if the metal shaft is subjected to a bending process for a putter or the like.

PATENT DOCUMENT 1: JP 3157018 U

SUMMARY OF THE INVENTION

A problem to be solved is that a colored layer tends to be peeled off in a bending process or the like.

The present invention provides a golf shaft comprising an element tube made of metal, and a colored plating layer being a colored layer formed on a surface of the element tube, wherein the colored plating layer comprises a semigloss plating layer layered on the surface of the element tube, a first strike plating layer layered on a surface of the semigloss plating layer, a satin-like plating layer layered on a surface of the first strike plating layer, a second strike plating layer layered on a surface of the satin-like plating layer, and a decorative plating layer layered outside the second strike plating layer and colored according to a color of the colored plating layer.

Further, the present invention provides a method of manufacturing the golf shaft, comprising in a first line, layering the semigloss plating layer on the surface of the element tube and layering the first strike plating layer on the surface of the semigloss plating layer, in a second line, layering the satin-like plating layer on the surface of the first strike plating layer and layering the second strike plating layer on the surface of the satin-like plating layer, and in a third line, layering the decorative plating layer outside the second strike plating layer.

The present invention ensures peeling resistance of the colored layer to endure even a bending process and the like.

BRIEF DESCRIPTION OF THE DRAWINGS

FIGS. 1A and 1B are side views of a golf shaft according to an embodiment 1 of the present invention, in which FIG. 1A illustrates a whole of the golf shaft and FIG. 1B illustrates a part of FIG. 1A enlarged;

FIGS. 6A and 6B are photographs illustrating states of colored layers of golf shafts after a scratch test, in which FIG. 6A is an embodied product and FIG. 6B is a comparative example product.

EMBODIMENT FOR CARRYING OUT THE INVENTION

Figure 1A:
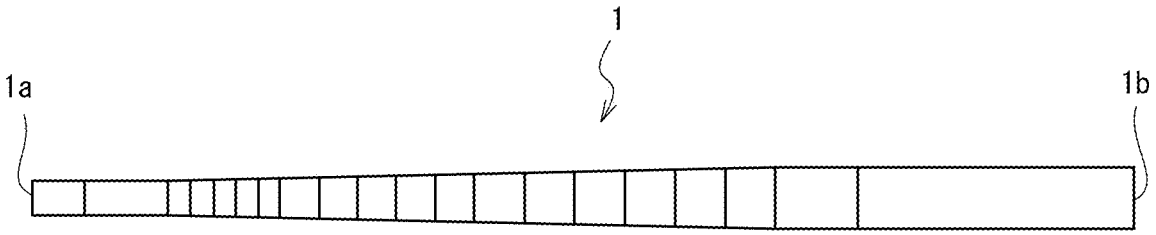

The present invention accomplishes the object of ensuring peeling resistance of a colored layer to endure even a bending process and the like by a layer structure of a colored plating layer being the colored layer formed on a surface of an element tube made of metal.

Namely, a golf shaft (1) comprises an element tube (3) made of metal, and a colored plating layer (5) being a colored layer formed on a surface of the element tube (3). The colored plating layer (5) comprises a semigloss plating layer (7), a first strike plating layer (9), a satin-like plating layer (11), a second strike plating layer (13) and a decorative plating layer (15). The semigloss plating layer (7) is layered on the surface of the element tube (3). The first strike plating layer (9) is layered on a surface of the semigloss plating layer (7). The satin-like plating layer (11) is layered on a surface of the first strike plating layer (9). The second strike plating layer (13) is layered on a surface of the satin-like plating layer (11). The decorative plating layer (15) is layered outside the second strike plating layer (13) and is colored according to a color of the colored plating layer (5).

It may be configured that the element tube (3) is made of steel, the semigloss plating layer (7), the first strike plating layer (9), the satin-like plating layer (11), and the second strike plating layer (13) are formed of coatings of nickel plating, and the decorative plating layer (15) is formed of a coating of trivalent chromium plating.

It may be configured that the decorative plating layer (15) is layered on a surface of the second strike plating layer (13) and the colored plating layer (5) further comprises a chromated layer (17) layered on a surface of the decorative plating layer (15).

It may be configured that the colored plating layer (5) further comprises a seal plating layer (19) layered on a surface of the second strike plating layer (13) and the decorative plating layer (15) is layered on a surface of the seal plating layer (19).

A color of the colored plating layer (5) may be mat black, mat silver or mat grey.

A method of manufacturing the golf shaft may perform plating at a first line, a second line and a third line. In this case, in the first line, the semigloss plating layer (7) is layered on the surface of the element tube (3) and the first strike plating layer (9) is layered on the surface of the semigloss plating layer (7). In the second line, the satin-like plating layer (11) is layered on the surface of the first strike plating layer (9) and the second strike plating layer (13) is layered on the surface of the satin-like plating layer (11). In the third line, the decorative plating layer (15) is layered outside the second strike plating layer (13).

Figure 1B:
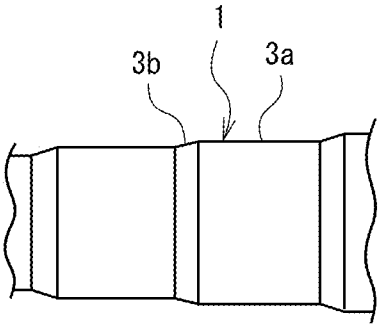
Figure 2:
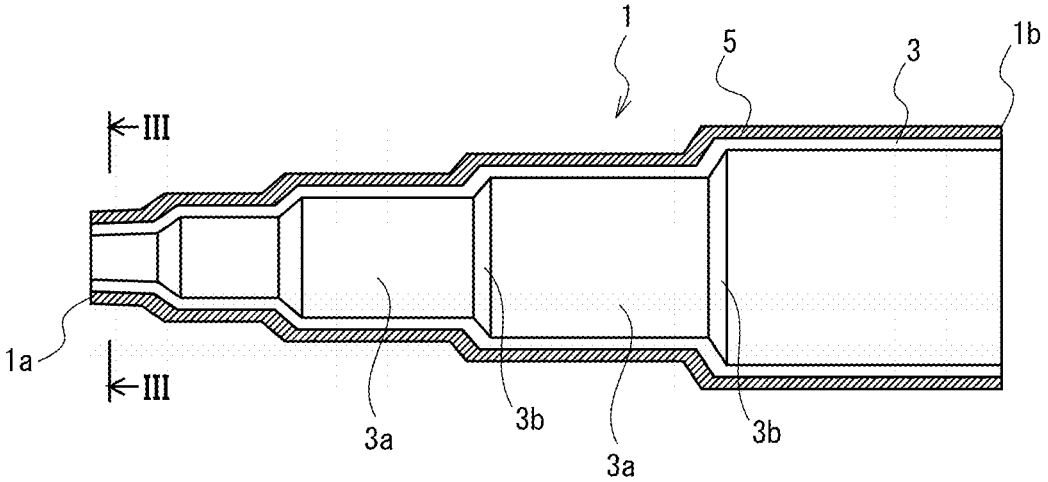
FIG. 2 is a schematic longitudinal sectional view of the golf shaft of FIG. 1.
Figure 3:
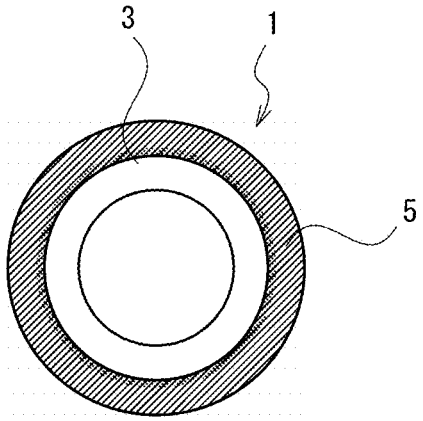
FIG. 3 is a schematic cross sectional view of the golf shaft taken along a line III-III of FIG. 2.

FIGS. 1A and 1B are side views of a golf shaft according to the embodiment 1 of the present invention, in which FIG. 1A illustrates a whole of the golf shaft and FIG. 1B illustrates a part of FIG. 1A enlarged. FIG. 2 is a schematic longitudinal sectional view of the golf shaft. FIG. 3 is a schematic cross sectional view of the golf shaft taken along a line III-III of FIG. 2. It should be noted that, although FIGS. 1A-3 do not correspond with each other in dimension of each part, they are basically the same structure.

A golf shaft 1 of the present embodiment has a tip end 1*a* in an axial direction that is a portion to attach a head of a golf club thereto, and a base end 1*b* in the axial direction of the golf shaft 1 that is a portion to attach a grip of the golf club thereto. The golf shaft 1 is a metal shaft, and is formed to have an element tube 3, and a colored plating layer 5.

The element tube 3 is a hollow tube, a sectional shape in a cross section of which is circular. The element tube 3 is made of metal, in particular steel. The material of the element tube 3 may be, however, the other material such as aluminum, titan, either alloy of them or the like.

The element tube 3 of the present embodiment has a stepped outer shape, and is configured by a plurality of straight tube parts 3*a* and a plurality of tapered tube parts 3*b* each connecting adjacent straight tube parts 3*a*.

The straight tube part 3*a* is a portion at which a wall thickness and diameters of inner and outer peripheries are constant. The straight tube part 3*a* located on the base end 1*b* side has the larger diameters of the inner and outer peripheries and the thinner wall thickness than the straight tube part 3*a* located on the tip end 1*a* side.

Each tapered tube part 3*b* is to absorb differences in diameter and wall thickness between adjacent straight tube parts 3*a*. Each tapered tube part 3*b* gradually increases in the diameters of the inner and outer peripheries and becomes gradually thin in the wall thickness from the tip end 1*a* side toward the base end 1*b* side. Lengths of the tapered tube parts 3*b* in the axial direction are shorter than of the straight tube parts 3*a*.

It should be noted that the element tube 3 is an example on which the colored plating layer 5 is formed. Accordingly, the element tube 3 is not limited to the stepped one, but may have a straight shape with a constant diameter of the outer periphery or an entirely tapered tubular shape. Further, the wall thickness of the element tube 3 may be constant or partially altered in the axial direction. Furthermore, the sectional shape in the cross section of the element tube 3 is not limited to the circular shape and may be an oval shape or the like appropriately selected.

The colored plating layer 5 is a colored layer formed on a surface of the element tube 3. A color of the colored plating layer 5 is mat black according to the present embodiment, but may be the other color such as mat silver or mat grey.

Figure 4:
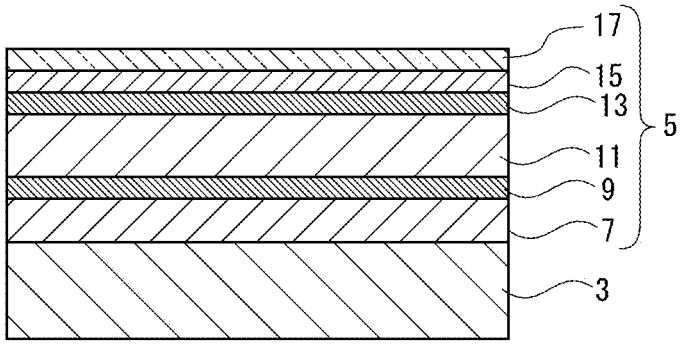
FIG. 4 is a schematic sectional view of a layer structure of a colored plating layer of the golf shaft of FIG. 3.

FIG. 4 is a schematic sectional view illustrating a layer structure of the colored plating layer 5.

The colored plating layer 5 of the present embodiment is configured by a semigloss plating layer 7, a first strike plating layer 9, a satin-like plating layer 11, a second strike plating layer 13, a decorative plating layer 15, and a chromated layer 17 sequentially layered from the surface of the element tuber 3.

The semigloss plating layer 7 is formed of a coating of semigloss plating layered on the surface of the element tube 3. The material of the semigloss plating layer 7 may be nickel, copper, gold, tin or the like according to the material of the element tube 3. The semigloss plating layer 7 of the present embodiment is a coating of semigloss nickel plating, the material of which is nickel.

The semigloss plating layer 7 has a mat metallic (silver) appearance with, for example, a degree of gloss being about 0.3-0.5, a content percentage of sulfur constituent of which is about 0.005% less than the order of 0.01%, and a thickness of which is 4 μm-14 μm, for example, about 6.7 μm. The degree of gloss, the content percentage of sulfur constituent, the thickness and the like of the semigloss plating layer 7 are not limited thereto.

The first strike plating layer 9 is layered on a surface of the semigloss plating layer 7 as a coating of strike plating on the element tube 3 side. The material of the first strike plating layer 9 may be nickel, silver, copper, gold, palladium or the like according to the materials of the semigloss plating layer 7 and the satin-like plating layer 11. The first strike plating layer 9 of the present embodiment is formed of a coating of nickel strike plating, the material of which is nickel.

The first strike plating layer 9 has a metallic (silver) appearance. A content percentage of sulfur constituent of the first strike plating layer 9 is the order of 0.1%, and a thickness of the first strike plating layer 9 is very thin and about 0.1 μm-0.3 μm, for example, about 0.24 μm. The content percentage of sulfur constituent, the thickness and the like of the first strike plating layer 9 are not, however, limited thereto.

The satin-like plating layer 11 is layered as a coating of satin-like plating on a surface of the first strike plating layer 9. The coating formed by the satin-like plating has fine irregularities on a surface thereof to have a velvet-like appearance. In addition, the satin-like plating will be explained later.

The material of the satin-like plating layer 11 may be nickel, cobalt, copper or the like according to the materials of the first strike plating layer 9 and the second strike plating layer 13. The satin-like plating layer 11 of the present embodiment is formed of a coating of velour nickel plating that is nickel.

The satin-like plating layer 11 has a thickness of about 4 μm-14 μm, for example, about 9.89 μm and is thicker than the first strike plating layer 9 and the semigloss plating layer 7. It should be noted that the thickness of the satin-like plating layer 11 is not limited thereto. The surface of the satin-like plating layer 11 has a mat or almost matrix metallic (silver) appearance. A hardness of the satin-like plating layer 11 is lower than of the first strike plating layer 9 and the second strike plating layer 13.

The second strike plating layer 13 is a coating of strike plating layered on the surface of the satin-like plating layer 11, and is the same coating of the nickel strike plating as the first strike plating layer 9 according to the present embodiment. In addition, the same means that specifications of the material, the thickness and the like are the same. It should be noted that the second strike plating layer 13 may not be the same as the first strike plating layer 9 and may be altered in material, thickness and the like.

The decorative plating layer 15 is formed of a coating of decorative plating layered outside the second strike plating layer 13, on a surface of the second strike plating layer 13 according to the present embodiment. The decorative plating layer 15 is colored according to the color of the colored plating layer 5. The colored according to the color of the colored plating layer 5 means a color tone except for the presence or absence of gloss and metallic feeling. In the case that the color plating layer 5 is mat black, therefore, the decorative plating layer 15 has a black color tone. In addition, the metallic feeling is a state that the metallic color of the lower layer is seen through the decorative plating layer 15.

The decorative plating layer 15 may be formed of a coating of trivalent chromium plating, quadrivalent chromium plating or the like. The decorative plating layer 15 of the present embodiment is formed of a coating of black trivalent chromium plating. In addition, there are nickel plating, zinc plating and the like other than the trivalent chromium plating for the coating of the black decorative plating layer.

Further, the decorative plating layer 15 may be silver (white), grey or the like in the case of the coating of the trivalent chromium plating. The grey is an intermediate color between black and white. If the decorative plating layer 15 is colored in white, the colored plating layer 5 has a mat silver color, and if the decorative plating layer 15 is colored in grey, the colored plating layer 5 has a mat grey color. A thickness of the decorative plating layer 15 is about 0.1 μm-0.5 μm, for example, about 0.31 μm.

The chromated layer 17 is formed of a coating by means of chromate treatment layered on a surface of the decorative plating layer 15. The chromated layer 17 improves corrosion resistance and discoloration resistance of the colored plating layer 5. The chromated layer 17 may be colorless and transparent or colored, and is colorless and transparent according to the present embodiment. A thickness of the chromated layer 17 is about 1 to tens nm.

FIGS. 5A-5D are schematic sectional views illustrating a forming method of the colored plating layer of the golf shaft.

Figure 5A:
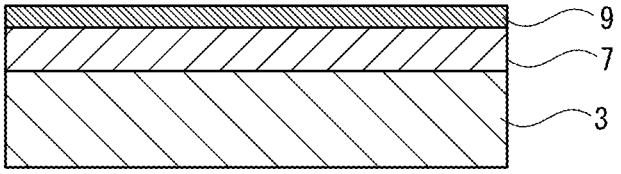
FIGS. 5A-5D are schematic sectional views illustrating a forming method of the colored plating layer of the golf shaft.

When forming the colored plating layer 5 on the golf shaft 1, the semigloss plating layer 7 is layered on the surface of the element tube 3 of the golf shaft 1 and the first strike plating layer 9 is layered on the surface of the semigloss plating layer 7 in a first line as illustrated in FIG. 5A, first.

Since the semigloss plating layer 7 is the coating of the semigloss nickel plating, the semigloss nickel plating is conducted to the element tube 3 in the formation of the semigloss plating layer 7. The semigloss nickel plating should adopt a known one and is conducted by electro nickel plating or the like with a nickel plating bath into which a semigloss additive is added. The nickel plating bath composed mainly of, for example, nickel chloride, nickel sulfate, and boric acid is used.

The semigloss additive should be a semigloss additive making the semigloss plating layer 7 include no sulfur (for example, making the content percentage become less than 0.05% in measurement using a fluorescent X-ray), and Acuna SL-MU manufactured by OKUNO Chemical Industries Co., Ltd. or the like may be used as the semigloss additive, for example.

In an example of the nickel plating bath, nickel sulfate is 240-320 g/L, nickel chloride is 30-50 g/L, boric acid is 30-50 g/L, and Acuna SL-MU is 1-3 ml/L.

On the semigloss plating layer 7, the first strike plating layer 9 is formed in the same first line.

Since the first strike plating layer 9 is formed of the coating of the nickel strike plating, the nickel strike plating is conducted to the element tube 3 having the semigloss plating layer 7 in the formation of the first strike plating layer 9.

The nickel strike plating should adopt a known one, and is conducted using a strike bath or the like composed mainly of, for example, nickel chloride, and hydrochloric acid. In an example of the strike bath, hydrochloric acid is 110±15 ml/L, and nickel chloride is 270±30 g/L. In addition, boric acid functioning as a buffer agent and a mist suppressant may be added to the strike bath.

With the formation of the first strike plating layer 9, an oxide film formed at the time of drying the semigloss plating layer 7 is removed and is prevented from being formed again, and adhesion of the subsequent satin-like plating layer 11 containing oil is improved.

Figure 5B:
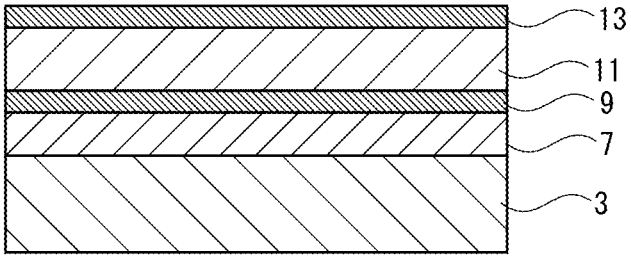

Next, the satin-like plating layer 11 is layered on the surface of the first strike plating layer 9 and the second strike plating layer 13 is layered on the surface of the satin-like plating layer 11 in the second line as illustrated in FIG. 5B.

Since the satin-like plating layer 11 is formed of the coating of the velour nickel plating, the velour nickel plating is conducted to the element tube 3 on which the first strike plating layer 9 is formed in the formation of the satin-like plating layer 11. The velour nickel plating should adopt a known one, and is conducted by the electro nickel plating or the like using a velour plating bath in which additives are added to a nickel plating bath composed mainly of, for example, nickel sulfate, nickel chloride, and boric acid.

In an example of the velour plating bath, nickel sulfate is 270±25 g/L, nickel chloride is 50±10 g/L, boric acid is 35±5 g/L, and a velour additive #50 is 30±8 ml/L, and a velour additive #30 is 2.5±0.5 ml/L.

In addition, the satin-like plating includes plating such as satin plating and velour plating to provide a formed coating with a velvet-like appearance. As the satin-like plating, Dia satin manufactured by C. Uyemura & Co., Ltd., Sachilite nickel manufactured by JCU CORPORATION and the like are known in addition to velour nickel.

On the satin-like plating layer 11, the second strike plating layer 13 is formed in the same second line.

Since the second strike plating layer 13 is the same as the first strike plating 9, the nickel strike plating being the same as at the time of forming the first strike plating layer 9 is conducted to the element tube 3 on which the satin-like plating layer 11 is formed, in the formation of the second strike plating layer 13.

With the formation of the second strike plating layer 13, an oxide film is prevented from being formed on the satin-like plating layer 11, and adhesion between the satin-like plating layer 9 containing oil and the subsequent decorative plating layer 15 is improved.

Figure 5C:
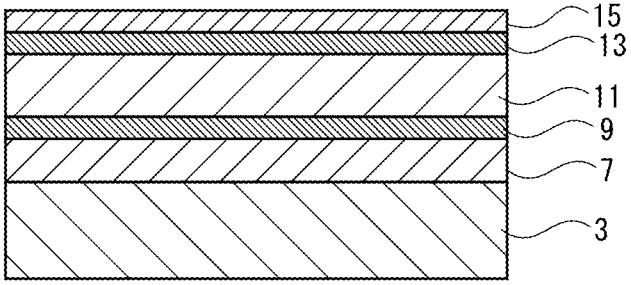

Next, the decorative plating layer 15 is layered on the surface of the second strike plating layer 13 in the third line as illustrated in FIG. 5C.

Since the decorative plating layer 15 is formed of the coating of the black trivalent chromium plating, the black trivalent chromium plating is conducted to the element tube 3 on which the second strike plating layer 13 is formed in the formation of the decorative plating layer 15.

The black trivalent chromium plating adopt a known one, and is conducted using a black trivalent chromium plating bath composed mainly of a trivalent chromium compound and including an additive for the black color. In an example of the black trivalent chromium plating bath, there is Trichrome graphite manufactured by Atotech Japan. It should be noted that the black trivalent chromium plating is varied in color tone of black according to a manufacturer and may be bluish black, reddish black or the like.

If the decorative plating layer 15 is in white (silver), white trivalent chromium plating should be conducted instead of the black trivalent chromium plating. In the white trivalent chromium plating, a white trivalent chromium plating bath such as Trichrome plus manufactured by Atotech Japan is used for example. If the decorative plating layer 15 is in grey, a plating bath which is the plating bath of the black trivalent chromium plating adjusted in color tone should be used to conduct the trivalent chromium plating. As an example of the grey plating solution, there is Top fine chrome LG manufacture by OKUNO Chemical Industries Co., Ltd.

Figure 5D:
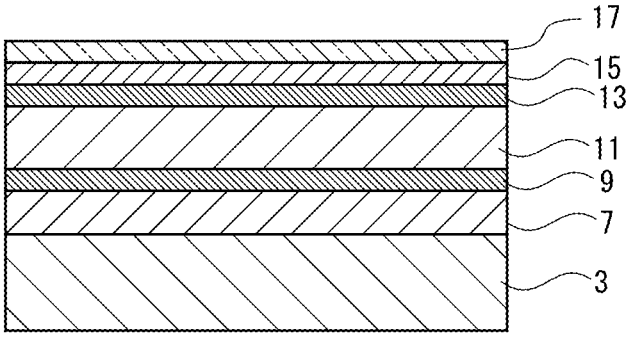

Finally, the chromated layer 17 is formed on the decorative plating layer 15 as illustrated in FIG. 5D.

The chromated layer 17 may be formed by known chromate treatment. As the chromate treatment, electrolytic chromate treatment using chromate treatment solution composed mainly of, for example, a trivalent chromium compound is conducted to the element tube 3 on which the decorative plating layer 15 is formed.

In this way, the chromated layer 17 is formed to finish the colored plating layer 5 of the golf shaft 1. The semigloss plating layer 7 is mat metallic color, the first and the second strike plating layers 9 and 13 are metallic color, the satin-like plating layer 11 is mat metallic color, the decorative plating layer 15 is black, the chromated layer 17 is colorless and transparent, and the finished colored plating layer 5 is mat black as a whole.

If the decorative plating layer 15 is in white (silver), the whole is mat silver, and if the decorative plating layer 15 is in grey, the whole is mat grey.

Since the decorative plating layer 15 on the surface layer of the colored plating layer 5 is formed of the coating of the trivalent chromium plating, the golf shaft 1 of the present embodiment obtains the colored plating layer 5 with high durability while being mat black.

Figure 6A:
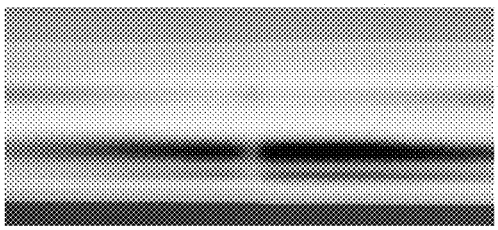
Figure 6B:
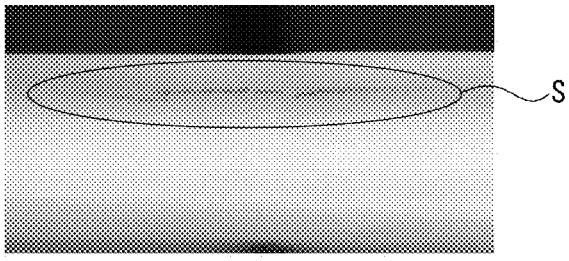

FIGS. 6A and 6B are photographs illustrating states of colored layers of the golf shafts 1 after a scratch test, in which FIG. 6A is an embodied product and FIG. 6B is a comparative example product. In addition, in FIGS. 6A and 6B, black and white are inverted to be indicated in view of visibility.

The embodied product is the golf shaft 1 of the present embodiment and the comparative example product is that a paint film layer is formed as a colored layer on a decorative plating layer after sequentially forming a semigloss plating layer, a gloss plating layer, a seal plating layer and the decorative plating layer from a surface of an element tube similar to a general golf shaft. Each of the semigloss plating layer, the gloss plating layer, and the seal plating layer is a coating of nickel plating having a sealing property (see embodiment 2 for details), the decorative plating layer is a coating of hexavalent chromium plating, and the paint film layer is a coating of black painting.

The scratch test was conducted by rubbing the embodied product and the comparative example product intersecting with each other. As a result, visible scratches S were occurred on the comparative example product whereas no visible scratch was occurred on the embodied product.

The golf shaft 1 of the present embodiment ensures peeling resistance of the colored layer to endure a bending process and the like. It should be noted that the peeling resistance means difficulty in peeling off. In the golf shaft 1 of the embodied product, no peeling was occurred even when bending is conducted at a bending angle of 30 degrees with a curvature radius of 60 mm. On the other hand, in the golf shaft of the comparative example product, peeling of the paint film layer was occurred by the similar bending. In addition, the bending was conducted by a press. In a golf shaft for a putter, there are one bending or two bendings and the bendings require bending angles of about 5-25 degrees, and the golf shaft 1 of the present embodiment obtains the colored layer enduring the bending requirement.

The peeling resistance of the embodied product is obtained by that the first strike plating layer 9 improves adhesion between the semigloss plating layer 7 and the satin-like plating layer 11 and the second strike plating layer 13 improves adhesion between the satin-like plating layer 11 and the decorative plating layer 15.

Further, the first and the second strike plating layers 9 and 13 have the same structure, so that adhering situations of the semigloss plating layer 7 and the decorative plating layer 15 with respect to the satin-like plating layer 11 are uniformed on both sides in a layer direction, thereby to prevent interfacial failure between the satin-like plating layer 11 and the semigloss plating layer 7 and the decorative plating layer 15, respectively. In addition, the layer direction means a layering direction of each layer of the colored plating layer 5.

Further, the first and the second strike plating layers 9 and 13 have relatively low rigidity, and the first and the second strike plating layers 9 and 13 function as binders each for an inter-layer to improve a followability of the colored plating layer 5 to a bending. The colored plating layer 5, therefore, has a structure strong against bending of the golf shaft 1.

As mentioned above, the golf shaft 1 of the present embodiment is provided with the element tube 3 made of metal, and the colored plating layer 5 being the colored layer formed on the surface of the element tube 3. The colored plating layer 5 is provided with the semigloss plating layer 7 layered on the surface of the element tube 3, the first strike plating layer 9 layered on the surface of the semigloss plating layer 7, the satin-like plating layer 11 layered on the surface of the first strike plating layer 9, the second strike plating layer 13 layered on the surface of the satin-like plating layer 11, and the decorative plating layer 15 layered on the surface of the second strike plating layer 13 and colored according to the color of the colored plating layer 5.

The present embodiment, therefore, improves in adhesion due to the first strike plating layer 9 and the second strike plating layer 13 and functions the first and the second strike plating layers 9 and 13 as the binders each for the inter-layer to improve the followability of the colored plating layer 5. This ensures the peeling resistance of the colored layer to endure a bending process and the like for the golf shaft 1.

Further, the colored plating layer 5 improves in adhesion to the element tube due to the semigloss plating layer 7, to ensure the peeling resistance of the whole colored layer relative to the element tube 3 and certainly obtain the mat color. Furthermore, the present embodiment gives the mat color, in particular mat black, due to the layer structure of the colored plating layer 5, so that high scratch resistance is obtained while colored in mat black. In addition, the case in which the colored plating layer 5 is colored in mat silver or mat grey also provides the same effect.

Further, the second strike plating layer 13 is the same as the first strike plating layer 9. Accordingly, the adhering situations of the semigloss plating layer 7 and the decorative plating layer 15 with respect to the satin-like plating layer 11 are uniformed, thereby to prevent interfacial failure between the satin-like plating layer 11 and the semigloss plating layer 7 and the decorative plating layer 15.

The element tube 3 is made of steel, and the semigloss plating layer 7, the first strike plating layer 9, the satin-like plating layer 11, and the second strike plating layer 13 are formed of the nickel platings, and the decorative plating layer 15 is formed of the trivalent chromium plating.

The peeling resistance of the whole colored layer relative to the element tube 3 is, therefore, further certainly obtained.

The colored plating layer 5 is provided with the chromated layer 17 layered on the surface of the decorative plating layer 15, so that the golf shaft 1 improves in corrosion resistance.

The method of manufacturing the golf shaft 1 layers the semigloss plating layer 7 on the surface of the element tube 3 and layers the first strike plating layer 9 on the surface of the semigloss plating layer 7 in the first line, layers the satin-like plating layer 11 on the surface of the first strike plating layer 9 and layers the second strike plating layer 13 on the surface of the satin-like plating layer 11 in the second line, and layers the decorative plating layer 15 on the surface of the second strike plating layer 13 in the third line.

It, therefore, surely manufactures the golf shaft 1, the colored layer of which has the peeling resistance to endure a bending process and the like.

Figure 7:
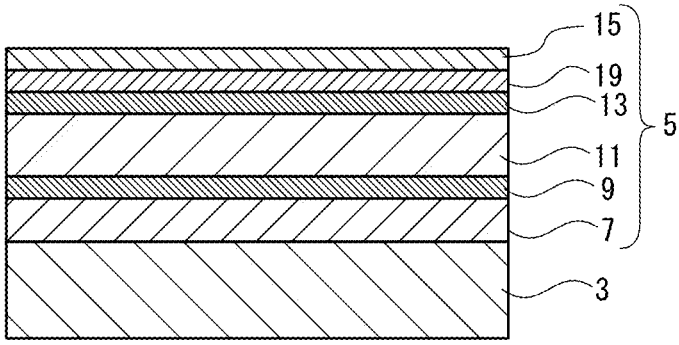
FIG. 7 is a schematic sectional view illustrating a layer structure of a colored plating layer of a golf shaft according to an embodiment 2 of the present invention.

FIG. 7 is a schematic sectional view illustrating a layer structure of a colored plating layer of a golf shaft according to the embodiment 2 of the present invention. In addition, in the embodiment 2, components being the same as those of the embodiment 1 are represented with the same reference numerals to eliminate repetition in description.

A golf shaft 1 of the present embodiment is provided with a seal plating layer 19 instead of the chromated layer 17. The other configuration is the same as of the embodiment 1.

The seal plating layer 19 is provided between a second strike plating layer 13 and a decorative plating layer 15. Namely, the seal plating layer 19 is layered on a surface of the second strike plating layer 13, and the decorative plating layer 15 is layered on a surface of the seal plating layer 19. The present embodiment, therefore, is configured that the decorative plating layer 15 is layered outside the second strike plating layer 13 through the seal plating layer 19.

The seal plating layer 19 employs material in which a sealing property is added to nickel or the like that is relatively hard metal, or material which is indium, gold, silver or the like that is relatively soft metal. The material of the seal plating layer 19 of the present embodiment is a coating of seal nickel plating as nickel to which the sealing property is added.

In the formation of the seal plating layer 19, the seal nickel plating is conducted to the element tube 3 to which the second strike plating layer 11 is formed thus far. The seal nickel plating should adopt a known one, and is conducted by the electro nickel plating or the like using a seal plating bath in which additives are added to a nickel plating bath composed mainly of, for example, nickel sulfate, nickel chloride, and boric acid.

In an example of the seal plating bath, nickel sulfate is 180±40 g/L, nickel chloride is 25±8 g/L, and boric acid is 25±8 g/L. As the additive used in the seal plating bath, there are Improved acuna B-1, Improved acuna B-2, Seal nickel HCR-K-4, Seal nickel SMPC-4 and the like manufactured by OKUNO Chemical Industries Co., Ltd.

The embodiment 2 provides the same effects as the embodiment 1.

The invention claimed is:

1. A golf shaft comprising:

an element tube made of metal; and a colored plating layer being a colored layer formed on a surface of the element tube, wherein the colored plating layer comprises:

a semigloss plating layer layered on the surface of the element tube;

a first strike plating layer layered on a surface of the semigloss plating layer;

a satin-like plating layer layered on a surface of the first strike plating layer;

a second strike plating layer layered on a surface of the satin-like plating layer; and a decorative plating layer layered outside the second strike plating layer and colored according to a color of the colored plating layer.

2. The golf shaft according to claim 1, wherein the element tube is made of steel, the semigloss plating layer, the first strike plating layer, the satin-like plating layer, and the second strike plating layer are formed of coatings of nickel plating, and the decorative plating layer is formed of a coating of trivalent chromium plating.

3. The golf shaft according to claim 1, wherein the decorative plating layer is layered on a surface of the second strike plating layer, and the colored plating layer further comprises a chromated layer layered on a surface of the decorative plating layer.

4. The golf shaft according to claim 1, wherein the colored plating layer further comprises a seal plating layer layered on a surface of the second strike plating layer, and the decorative plating layer is layered on a surface of the seal plating layer.

5. The golf shaft according to claim 1, wherein a color of the colored plating layer is mat black.

6. The golf shaft according to claim 1, wherein a color of the colored plating layer is mat silver.

7. The golf shaft according to claim 1, wherein a color of the colored plating layer is mat grey.

8. A method of manufacturing the golf shaft according to claim 1, comprising:

in a first line, layering the semigloss plating layer on the surface of the element tube and layering the first strike plating layer on the surface of the semigloss plating layer;

in a second line, layering the satin-like plating layer on the surface of the first strike plating layer and layering the second strike plating layer on the surface of the satin-like plating layer; and in a third line, layering the decorative plating layer outside the second strike plating layer.

* * * * *